United States Patent [19]

Schertenleib

[11] Patent Number: 4,986,293

[45] Date of Patent: Jan. 22, 1991

[54] CLEANING SYSTEM

[75] Inventor: Peter Schertenleib, Reliau, Fed. Rep. of Germany

[73] Assignee: Netzsch Mastermix Limited, Aldrige, United Kingdom

[21] Appl. No.: 262,330

[22] Filed: Oct. 25, 1988

[30] Foreign Application Priority Data

Oct. 27, 1987 [GB] United Kingdom ..... 8725145

[51] Int. Cl.[5] ..... B08B 3/02

[52] U.S. Cl. ..... 134/168 R; 134/171; 366/169

[58] Field of Search ..... 134/111, 113, 167 R, 134/168 R, 171; 366/137, 138, 169

[56] References Cited

U.S. PATENT DOCUMENTS

| | | | |
|---|---|---|---|
| 1,073,878 | 9/1913 | Trent | 366/169 X |
| 1,156,946 | 10/1915 | Vandercook | 366/137 |
| 1,978,015 | 10/1934 | Erdman | 366/138 X |
| 2,612,899 | 10/1952 | Webb | 134/168 R X |
| 2,764,171 | 9/1956 | Nolte | 134/168 R X |
| 2,933,093 | 4/1960 | Handyside | 134/168 R |
| 3,981,315 | 9/1976 | Olthoff | 134/167 R |
| 4,157,096 | 6/1979 | Miller, Jr. | 134/111 |
| 4,447,157 | 5/1984 | Underwood | 366/137 |

*Primary Examiner*—Philip R. Coe
*Attorney, Agent, or Firm*—Charles Berman

[57] ABSTRACT

A mixing and dispersion vessel is provided with an agitator blade shaped to conform to the cross-sectional shape of the vessel, and for the purpose of cleaning the agitator has a passage extending along its length with a number of orifices opening from the passage, and is supplied with solvent through a supply pipe extending to the exterior of the vessel.

3 Claims, 1 Drawing Sheet

CLEANING SYSTEM

Figure 1:
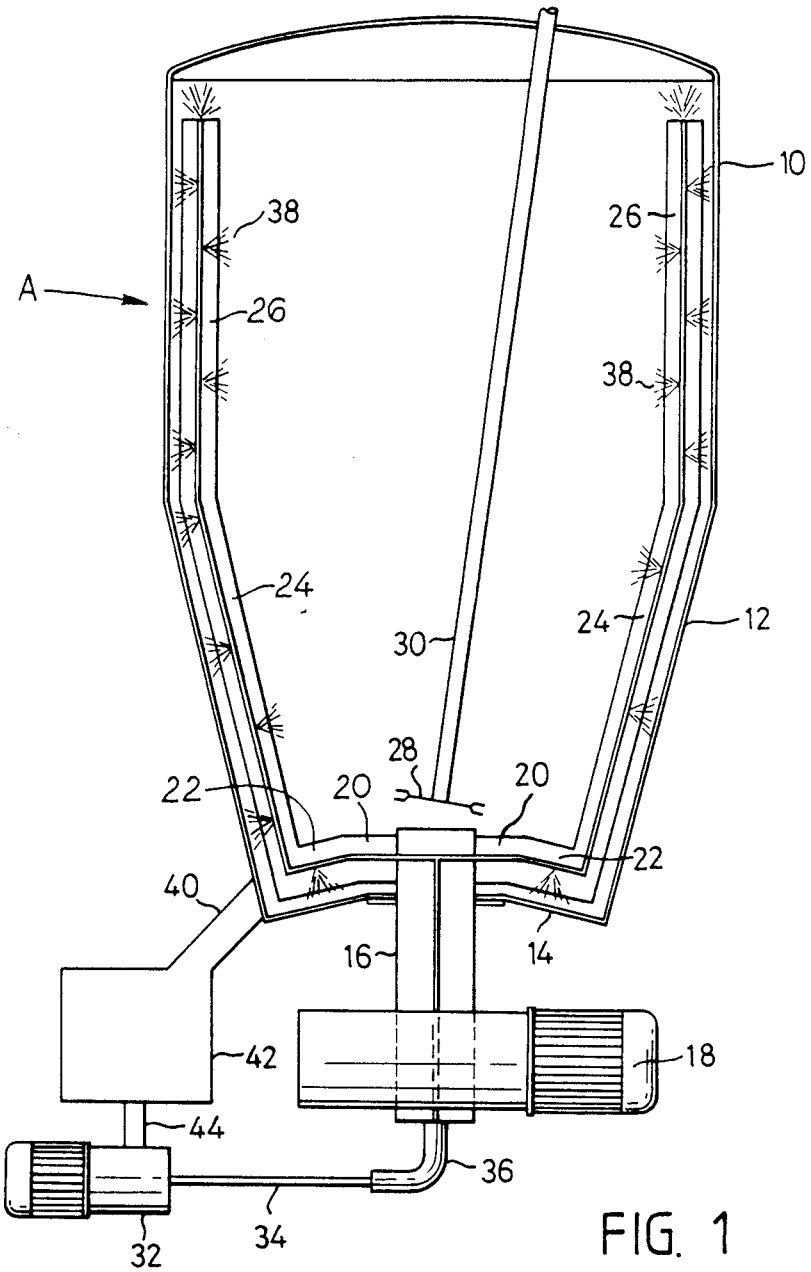

This invention relates to mixing and dispersing equipment of the kind comprising a vessel having an agitator blade which is shaped to conform to the cross-sectional shape of the vessel. Usually that agitator blade is rotated at a relatively low speed and one or more separate high-speed mixers are provided. Such apparatus is used for example in the manufacture of paint when the vessels may be large, for example and without limitation between 25 liter and 5000 liter capacity.

When such apparatus is used for different materials form time to time, it is necessary to clean the interior of the vessel and the agitator. Sometimes the agitator is fitted with a scraper blade with fits even more closely against the wall including the base of the vessel and in this case the cleaning is more difficult especially underneath or behind the scraper blade.

The objection of the invention is to provide a solution to these difficulties.

According to one aspect of the invention a method of cleaning a mixing and dispersing vessel of the kind provided with an agitator comprises delivery solvent from the exterior of the vessel via a rotary joint to a passageway extending along the agitator and through a series of orifices along the length of the same whilst the agitator is rotated in the vessel.

According to another aspect of the invention a mixing and dispersion vessel provided with an agitator is characterised by the provision of a solvent supply pipe connected to the agitator through a rotary joint, and the agitator has a passage extending along its length with a number of orifices opening from the said passage.

Whilst it would possible to pump solvent from a supply and allow it to drain to waste, it is preferred to provide a closed circuit system comprising a reservoir for the solvent connected both to the pump and to the drain from the vessel, possibly with an interposed filter, so that the solvent may be circulated until it runs clean.

The invention is more particularly described with reference to the accompanying drawing in which the sole FIGURE is diagrammatic elevation showing the vessel and the agitator in section.

The vessel A may have a complex cross-sectional shape, and as here illustrate, has a cylindrical upper portion 10, and a lower side wall portion 12 which is a narrow angle frusto-cone. The base of the vessel has a central planar portion surrounded by an annular very shallow angle frusto-cone 14. The low-speed agitator is bottom driven, that it to say shaft 16 extends through a seal and bearing in the bottom of the vessel, the shaft being driven by a main motor and gearbox assembly 18 below the vessel.

The low speed agitator conforms to the shape of the vessel closely, that is to say having horizontally extending arms 20, downwardly inclined portions 22, outwardly and upwardly inclined portions 24, and vertically extending portions 26. The usual high-speed mixer 28 on shaft 30 is located internally of the agitator.

The solvent circuit comprises pump 32 connected by pipe 34 to a rotary joint 36 for delivery via the bottom bearing into a set of passages extending along the whole of the length of the agitator. The agitator passageways opens to a plurality of washing jets or orifices through which the solvent is pumped as diagrammatically illustrated in the drawing for example by the reference numeral 38. Solvent is pumped whilst the agitator is rotated.

The solvent drains to the lowest point of the vessel and from there via the main drain passage 40 to the reservoir tank 42 from whence it returns to the pump 32 by passage 44. Strainers or filters may be provided at any convenient point. The system may include an observation port so that the solvent can be observed and contamination noted, enabling the solvent to be circulated until it drains clean.

I claim:

1. A mixing apparatus comprising: a vessel for containing a body of solvent, having a base and side-wall; a slow speed stirring paddle in the vessel and including blade portions located closely adjacent said side-wall and base; a shaft supporting said paddle; means for rotating said shaft and paddle at slow speed; at least one high speed agitator paddle mounted on a further shaft or shafts extending into said vessel; a passageway extending through said slow speed stirring paddle and said shaft supporting said paddle; a plurality of jet outlets from said passageway; pump means; a reservoir for cleaning fluid located externally of said vessel; a flow path opening from a lowest point in said vessel, extending to said shaft passageway, and including said reservoir and said pump; a rotary joint between said shaft passageway and said flow path; said cleaning fluid being pumped form the reservoir along the fluid path, through the shaft and passageway through the paddle to emerge from the jet outlets and be directed against side-wall and base while said shaft is rotated, so as to clean the side-wall and base, said cleaning fluid draining from the lowest point of said vessel to return to said flow path.

2. A mixing apparatus comprising: a vessel for containing a body of solvent, said vessel having a base and a side-wall; a slow speed stirring paddle in the vessel and including blade portions located closely adjacent said side-wall and base; a shaft supporting said paddle; means for rotating said shaft and paddle; a passageway extending through said paddle and said shaft supporting said paddle; a plurality of jet outlets from said passageway; pump means; a reservoir for cleaning fluid located externally of said vessel; a flow opening from a low point in said vessel, extending to said shaft passageway, and including said reservoir and said pump; a rotary joint between said shaft passageway and said flow path; said cleaning fluid being pumped from the reservoir along the fluid path, through the shaft and passageway through the paddle to emerge from the jet outlets and be directed against side-wall and base while said shaft is rotated, so as to clean the side-wall and base, said cleaning fluid drawing from the low point of said vessel to return to said flow path.

3. In a mixing apparatus of the kind comprising: a vessel for containing a body of solvent, said vessel having a circular cross-section and being defined by a base and a side-wall; a slow speed stirring paddle in the vessel and including blade portions located closed adjacent said side-wall and base; a shaft supporting said paddle; means for rotating said shaft and paddle at slow speed to stir the vessel contents; at least one high speed agitator paddle mounted on a further shaft or shafts extending into said vessel; the improvement comprising: a passageway extending through said slow speed stirring paddle and said shaft supporting said paddle; a plurality of jet outlets from said passageway; pump means; a reservoir for cleaning fluid located externally of said vessel; a flow path opening from a lowest point in said vessel, extending to such shaft passageway, and including said reservoir and said pump; a rotary joint between said shaft passageway and said flow path; whereby the said cleaning fluid may be pumped from the reservoir along the fluid path, through the shaft passageway through the paddle to emerge from the jet outlets and be directed against side-wall and base while said shaft is rotated, so as to clean the side-wall and base, said cleaning fluid draining from the lowest point of said vessel to return to said flow path.

* * * * *